US012692639B2

(12) United States Patent
Hong et al.

(10) Patent No.: US 12,692,639 B2
(45) Date of Patent: Jul. 28, 2026

(54) WASHING MACHINE AND METHOD OF CONTROLLING THE SAME

(71) Applicant: SAMSUNG ELECTRONICS CO., LTD., Suwon-si (KR)

(72) Inventors: Jeonggi Hong, Suwon-si (KR); Wonjae Han, Suwon-si (KR); Sungjong Kim, Suwon-si (KR); Hooijoong Kim, Suwon-si (KR); Hansol Youn, Suwon-si (KR); Sooyeon Jin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 265 days.

(21) Appl. No.: 18/300,270

(22) Filed: Apr. 13, 2023

(65) Prior Publication Data

US 2023/0407542 A1 Dec. 21, 2023

Related U.S. Application Data

(63) Continuation of application No. PCT/KR2023/003347, filed on Mar. 15, 2023.

(30) Foreign Application Priority Data

Jun. 15, 2022 (KR) ..... 10-2022-0073128

(51) Int. Cl.
*D06F 33/48* (2020.01)
*D06F 23/04* (2006.01)
(Continued)

(52) U.S. Cl.
CPC ..... *D06F 33/48* (2020.02); *D06F 23/04* (2013.01); *D06F 33/36* (2020.02); *D06F 33/40* (2020.02);
(Continued)

(58) Field of Classification Search
CPC ..... D06F 23/04; D06F 33/40; D06F 33/42; D06F 33/44; D06F 33/48; D06F 33/60;
(Continued)

(56) References Cited

U.S. PATENT DOCUMENTS 7,530,132 B2 5/2009 Kim
8,893,341 B2 11/2014 Park et al.
(Continued)

FOREIGN PATENT DOCUMENTS

CN 104862920 A 8/2015
EP 810389 A1 12/1997
(Continued)

OTHER PUBLICATIONS

International Search Report and Written Opinion of the International Searching Authority dated Jul. 13, 2023, in connection with International Application No. PCT/KR2023/003437, 7 pages.
(Continued)

*Primary Examiner* — David G Cormier

(57) ABSTRACT

Provided is a washing machine and a method of controlling the same, the washing machine including: a tub provided to accommodate water therein; a rotating tub rotatably installed inside the tub; a ball balancer provided in the rotating tub; a washing motor configured to rotate the rotating tub; a drain motor configured to drain water from the tub; and a controller configured to; based on completing a washing cycle or a rinsing cycle, drive the drain motor; based on a water level in the tub reaching a first water level threshold, drive the washing motor for a first period of time; and based on the first period of time elapsing, stop the washing motor and the drain motor.

8 Claims, 15 Drawing Sheets

(51) Int. Cl.

| | |
|---|---|
| ***D06F 33/36*** | (2020.01) |
| ***D06F 33/40*** | (2020.01) |
| ***D06F 33/42*** | (2020.01) |
| ***D06F 33/44*** | (2020.01) |
| ***D06F 34/22*** | (2020.01) |
| ***D06F 37/24*** | (2006.01) |
| ***D06F 37/30*** | (2020.01) |
| ***D06F 39/08*** | (2006.01) |
| *D06F 103/18* | (2020.01) |
| *D06F 105/08* | (2020.01) |
| *D06F 105/46* | (2020.01) |

(52) U.S. Cl.
CPC ..... *D06F 33/42* (2020.02); *D06F 33/44* (2020.02); *D06F 34/22* (2020.02); *D06F 37/245* (2013.01); *D06F 37/304* (2013.01); *D06F 39/083* (2013.01); *D06F 2103/18* (2020.02); *D06F 2105/08* (2020.02); *D06F 2105/46* (2020.02)

(58) Field of Classification Search
CPC ..... D06F 33/62; D06F 33/70; D06F 33/76; D06F 34/22; D06F 37/245; D06F 39/083; D06F 2103/18; D06F 2103/68; D06F 2105/08; D06F 2105/46
See application file for complete search history.

(56) References Cited

U.S. PATENT DOCUMENTS

| | | | |
|---|---|---|---|
| 9,637,854 | B2 | 5/2017 | Jung et al. |
| 10,066,333 | B2 | 9/2018 | Kim et al. |
| 10,533,275 | B2 | 1/2020 | Im et al. |
| 11,427,946 | B2 | 8/2022 | Choi et al. |
| 2005/0283919 | A1 | 12/2005 | Kim |
| 2012/0024016 | A1 | 2/2012 | Dunn et al. |
| 2015/0013077 | A1 | 1/2015 | Jung et al. |
| 2015/0233037 | A1 | 8/2015 | Kim et al. |
| 2015/0240406 | A1 | 8/2015 | Kim et al. |

FOREIGN PATENT DOCUMENTS

| | | | |
|---|---|---|---|
| EP | 2161371 | B1 | 4/2020 |
| JP | 2004008467 | A | 1/2004 |
| JP | 2017205340 | A | 11/2017 |
| KR | 10-1997-0075066 | A | 12/1997 |
| KR | 19990021192 | A | 3/1999 |
| KR | 10-2001-0002619 | A | 1/2001 |
| KR | 10-0338263 | B1 | 5/2002 |
| KR | 20100018240 | A | 2/2010 |
| KR | 10-2010-0040172 | A | 4/2010 |
| KR | 10-1065690 | B1 | 9/2011 |
| KR | 10-1386506 | B1 | 4/2014 |
| KR | 20150007633 | A | 1/2015 |
| KR | 20150099378 | A | 8/2015 |
| KR | 10-1667576 | B1 | 10/2016 |
| KR | 10-1940529 | B1 | 1/2019 |
| KR | 10-2089969 | B1 | 3/2020 |
| KR | 10-2105848 | B1 | 5/2020 |
| KR | 10-2325965 | B1 | 11/2021 |
| KR | 10-2328248 | B1 | 11/2021 |

OTHER PUBLICATIONS

Supplementary European Search Report dated May 8, 2025, in connection with European Patent Application No. 23824043.6, 12 pages.
Office Action issued Mar. 25, 2026, in connection with European Patent Application No. 23824043.6, 56 pages.

WASHING MACHINE AND METHOD OF CONTROLLING THE SAME

CROSS-REFERENCE TO RELATED APPLICATIONS

This application is a Bypass Continuation of International Application No. PCT/KR2023/003347, filed Mar. 15, 2023, which claims priority to Korean Patent Application No. 10-2022-0073128, filed Jun. 15, 2022, the disclosures of which are herein incorporated by reference in their entirety.

BACKGROUND

1. Field

The disclosure relates to a washing machine having a ball balancer for reducing vibration generated during a dehydrating cycle and a method of controlling the same.

2. Description of Related Art

A washing machine performs washing on laundry through a series of operations such as a washing cycle of separating pollutants from laundry with water (for example, wash water) in which detergent is dissolved, a rinsing cycle of rinsing foams or residual detergent with water (for example, rinsing water) containing no detergent, and a dehydrating cycle of removing moisture contained in the laundry with high velocity rotation.

When washing is performed through the series of operations, a rotating tub may be rotated in an unbalanced state in which a laundry is not evenly distributed in the rotating tub, in which case an eccentric force may be applied to a rotating shaft of the rotating tub, so that the rotating tub moves eccentrically and thus vibrations may be generated in the tub. The vibrations become severe when the rotating tub rotates at a high velocity for the dehydrating cycle, resulting in stronger vibrations and noise.

Accordingly, there has been continuous research on a washing machine equipped with a ball balancer capable of stabilizing rotation of a rotating tub by offsetting unbalanced load due to unbalance of laundry.

SUMMARY

One aspect of the disclosure provides a washing machine and a method of controlling the same that are capable of draining water in a process of entering a dehydrating cycle and when a predetermined water level is reached, starting the dehydrating cycle while a drain motor is in operation such that balls included in a ball balancer are located at a phase opposite to unbalance, thereby compensating for an imbalanced mass.

Another aspect of the disclosure provides a washing machine and a method of controlling the same that are capable of additionally draining water for a predetermined time, based on a washing motor being stopped after ball balancing is performed, so that foams generated during the ball balancing may be sufficiently discharged.

According to an aspect of the disclosure, there is provided a washing machine including: a tub provided to accommodate water therein; a rotating tub rotatably installed inside the tub; a ball balancer provided in the rotating tub; a washing motor configured to rotate the rotating tub; a drain motor configured to drain water from the tub; and a controller configured to based on completing a washing cycle or a rinsing cycle, drive the drain motor; based on a water level in the tub reaching a first water level threshold, drive the washing motor for a first period of time; and based on the first period of time elapsing, stop the washing motor and the drain motor.

The controller may be configured to, based on bringing the washing motor to a stopped state, drive the drain motor for a second period of time.

The controller may be configured to, based on the second period of time elapsing, stop the drain motor, and based on bringing the washing motor and the drain motor to stopped states, drive the washing motor and the drain motor according to a dehydrating profile.

The controller may be configured to drive the washing motor for the first period of time at a velocity higher than a rotation velocity in a predetermined resonance band of the rotating tub.

The controller may be configured to determine the first period of time based on an unbalance position of the rotating tub.

The controller may be configured to determine, as the first period of time, a time required to compensate for unbalance by a vector sum of a mass and a position of balls inside the ball balancer as the balls are located at a phase opposite to the unbalance position.

The washing machine may further include a water level sensor, wherein the controller may be configured to control the water level sensor to measure the water level in the tub after the washing motor is stopped.

The controller may be configured to determine the second period of time based on the water level measured by the water level sensor after the washing motor is stopped.

The controller may be configured to drive the drain motor after the washing motor is stopped, and based on the water level in the tub not reaching a second water level threshold within the second period of time, increase the second period of time.

The controller may BE configured to, based on the water level in the tub reaching the first water level threshold in a process of entering a dehydrating cycle, drive the washing motor for the first period of time.

According to an aspect of the disclosure, there is provided a method of controlling a washing machine, the method including, based on a washing cycle or a rinsing cycle being ended, driving a drain motor; based on a water level in a tub reaching a first water level threshold, driving a washing motor for a first period of time: and upon the first period of time elapsing, stopping the washing motor and the drain motor.

The method may further include, based on bringing the washing motor to a stopped state, driving the drain motor for a second period of time.

The method may further include at a time in which the second period of time has elapsed, stopping the drain motor; and based on bringing the washing motor and the drain motor to stopped states, driving the washing motor and the drain motor according to a dehydrating profile.

The method may further include driving the washing motor for the first period of time at a velocity higher than a rotation velocity in a predetermined resonance band of a rotating tub.

The method may further include determining the first period of time based on an unbalance position of a rotating tub.

The determining of the first period of time may include determining, as the first period of time, a time required to compensate for unbalance by a vector sum of a mass and a position of balls inside the ball balancer as the balls are located at a phase opposite to the unbalance position.

The method may further include controlling a water level sensor to measure the water level in the tub after the washing motor is stopped.

The method may further including determining the second period of time based on the water level measured by the water level sensor after the washing motor is stopped.

The method may further include driving the drain motor is driven after the washing motor is stopped; and based on the water level in the tub not reaching a second water level threshold, increasing the second period of time.

The driving of the washing motor for the first period of time based on the water level in the tub reaching the first water level threshold may be performed in a process of entering a dehydrating cycle.

As is apparent from the above, the washing machine according to an embodiment is implemented to compensate for an imbalance mass in an amount corresponding to a vector sum according to a mass and a position of balls included in a ball balancer, thereby suppressing excessive eccentricity. In addition, the washing machine is implemented to appropriately set a balancing RPM in consideration that the amount of foam generation, which is the cause of foam confinement, is proportional to a rotational RPM, and allocate an additional drainage time after a ball balancing in a state in which a motor is completely stopped, so that foam confinement can be prevented from occurring.

Before undertaking the DETAILED DESCRIPTION below, it may be advantageous to set forth definitions of certain words and phrases used throughout this patent document: the terms "include" and "comprise," as well as derivatives thereof, mean inclusion without limitation, the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Figure 11:
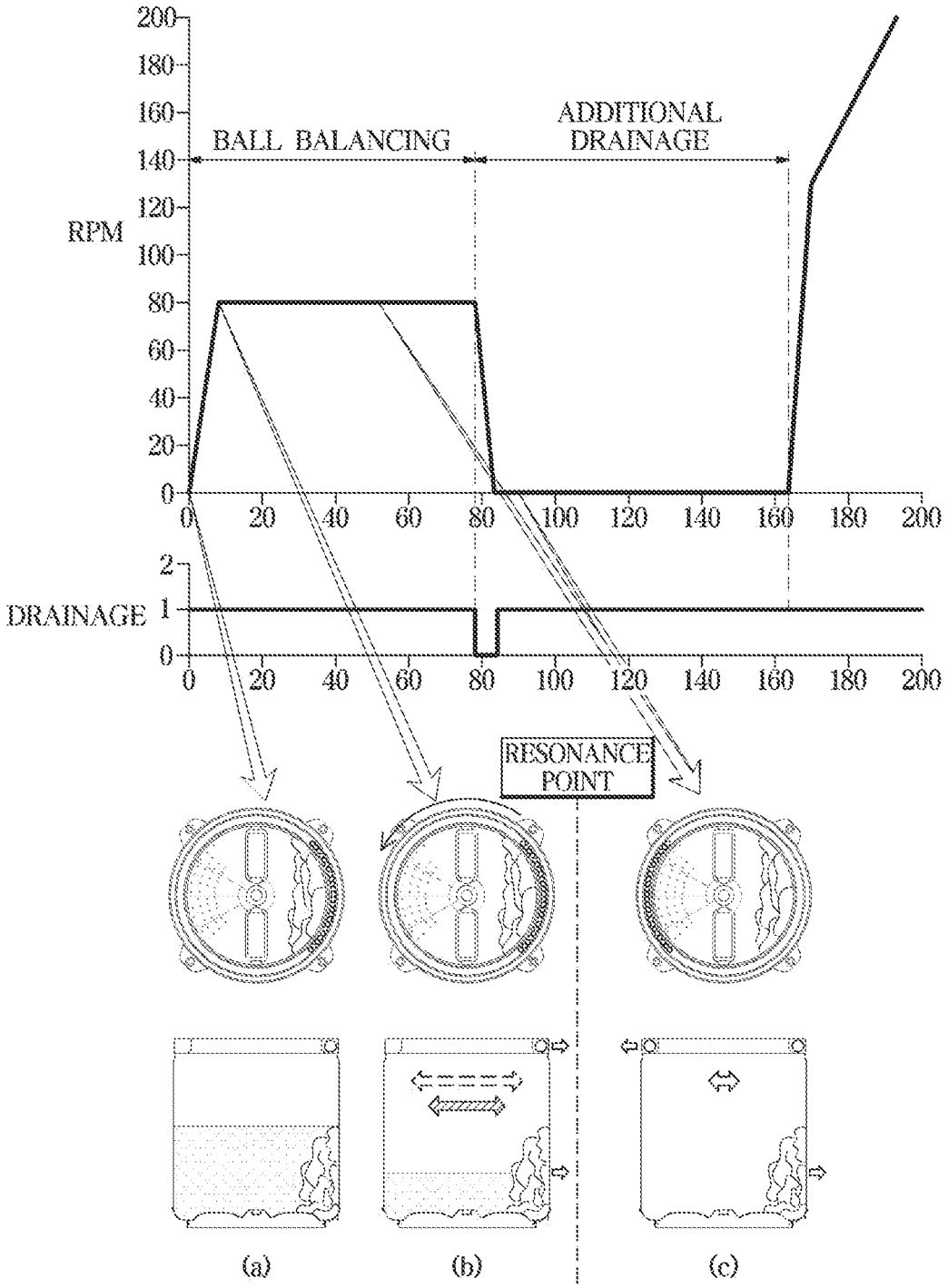

(a) of FIG. 11 is a graph showing a ball balancing and an additional drainage in a washing machine according to an embodiment.

(b) of FIG. 11 is a graph showing a ball balancing and an additional drainage in a washing machine according to an embodiment.

(c) of FIG. 11 is a graph showing a ball balancing and an additional drainage in a washing machine according to an embodiment.

Figure 12:
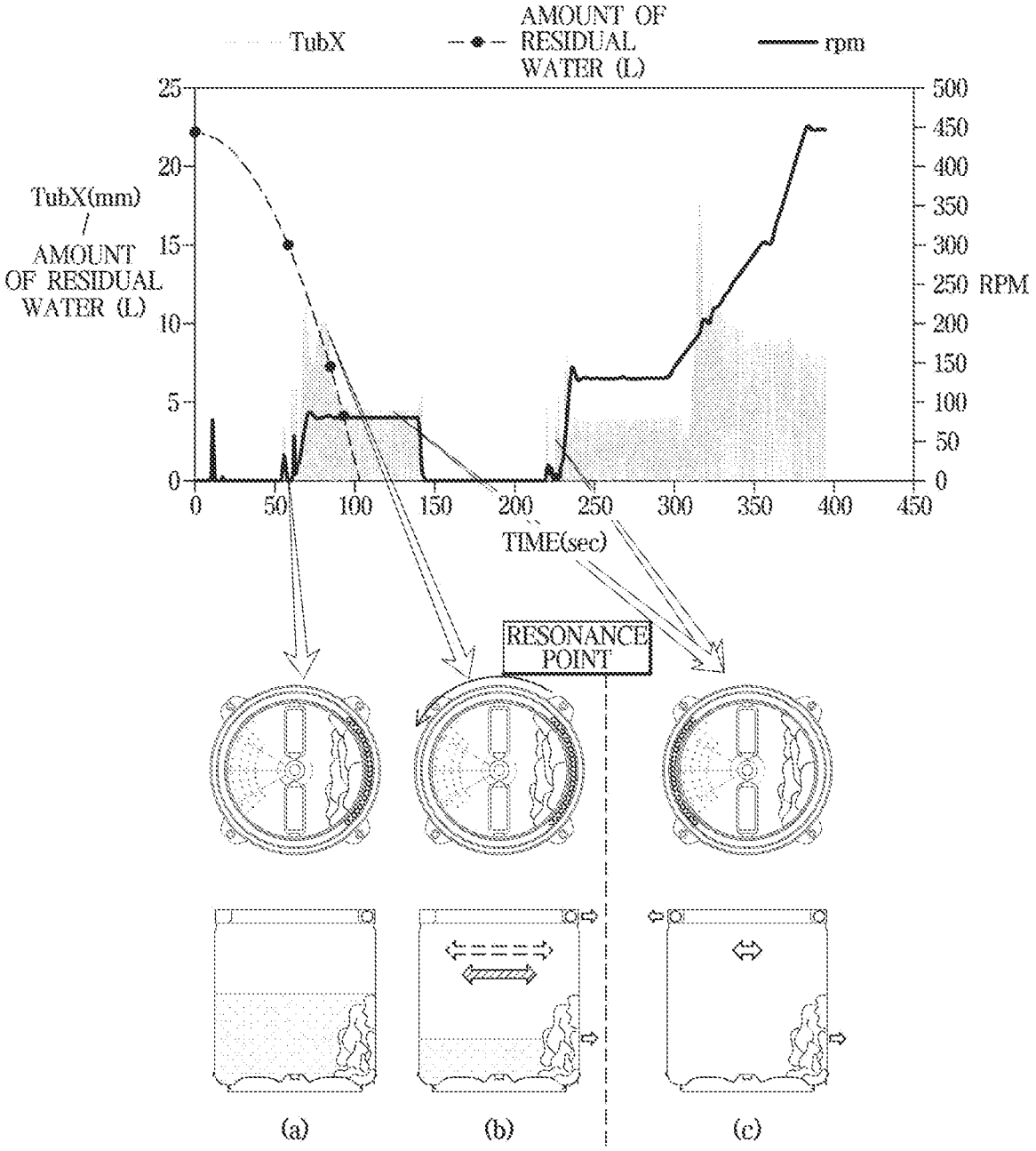
Figure 13:
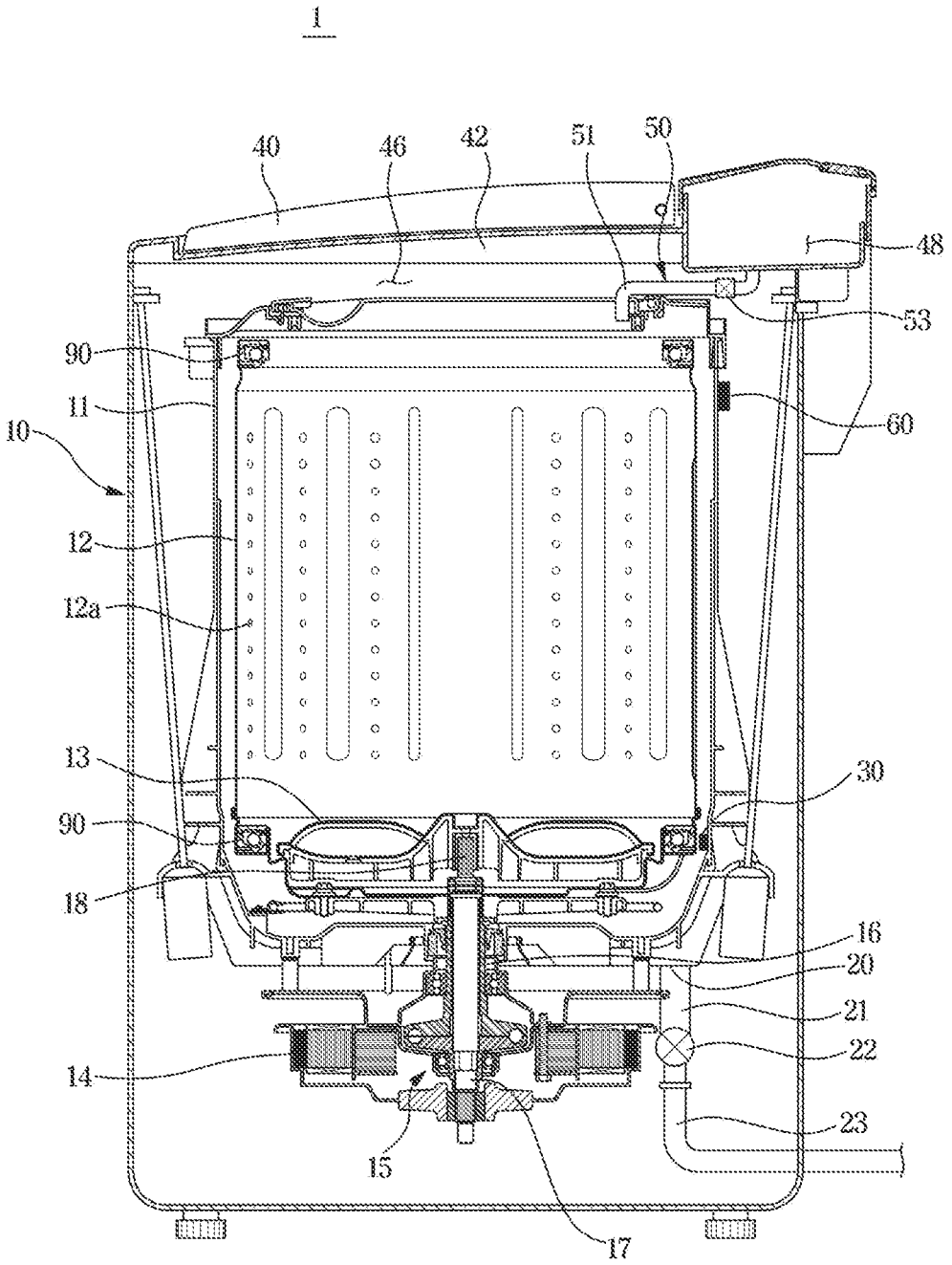

(a) of FIG. 12, (b) of FIG. 12, and (c) of FIG. 12 is a graph showing the amount of residual water, a vibration of a tub, and a rotation velocity of a washing motor over time in a washing machine according to an embodiment;

FIG. 13 is a cross-sectional view illustrating a configuration of a washing machine having a ball balancer according to another embodiment.

Figure 14:
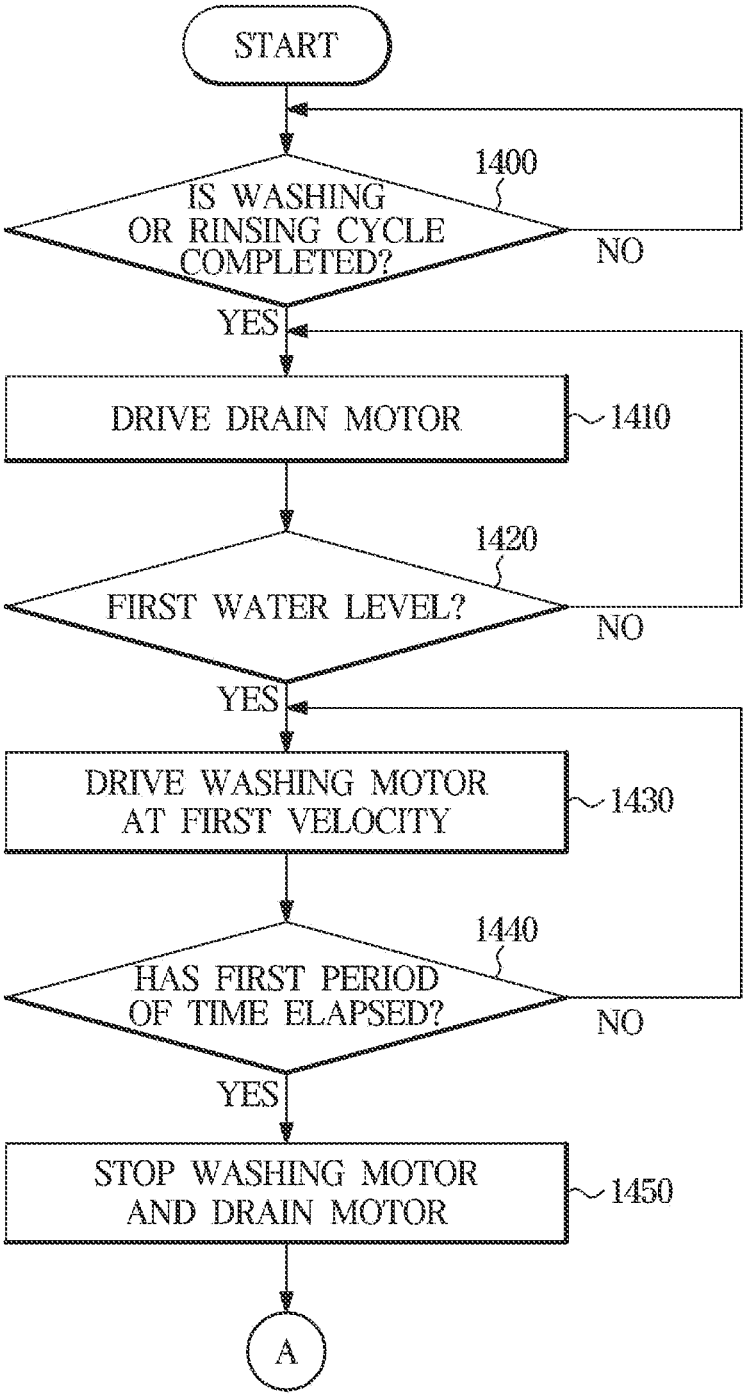

FIG. 14 is a flowchart showing a method of controlling a washing machine according to an embodiment.

Figure 15:
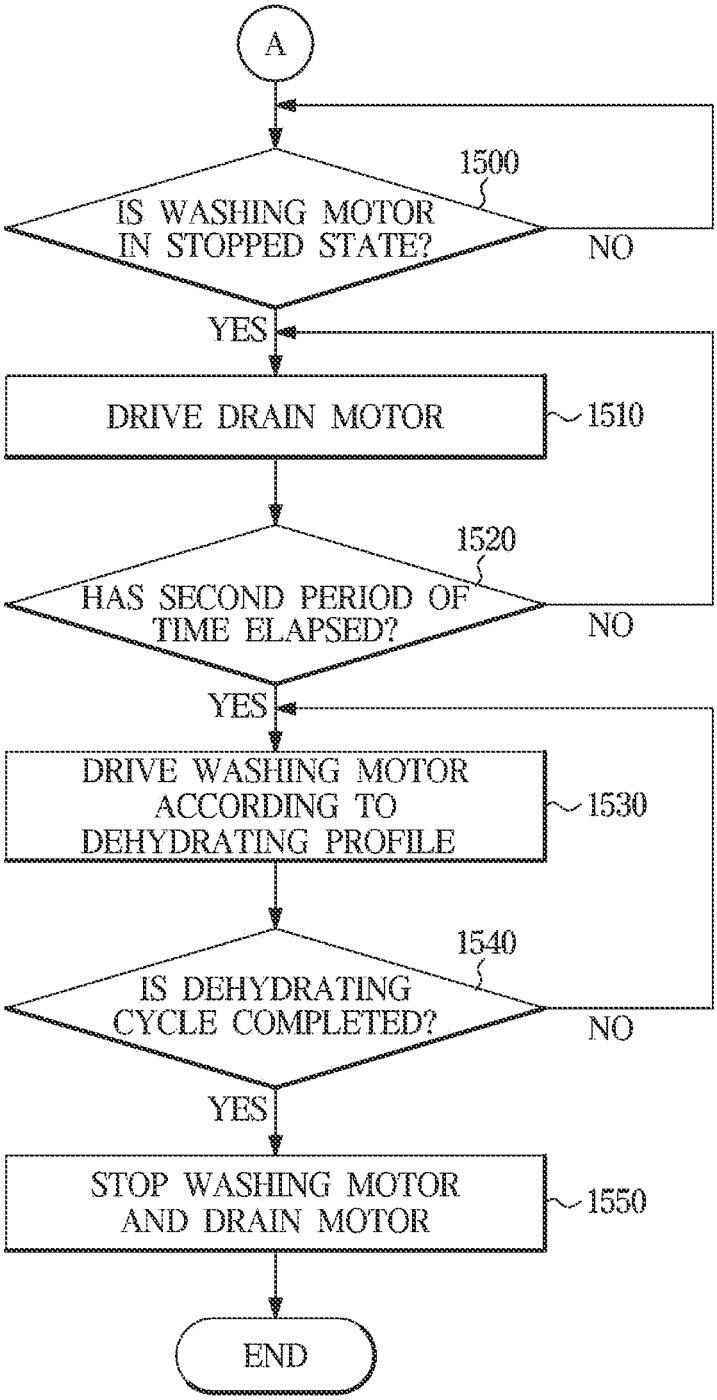

FIG. 15 is a flow chart showing a method of controlling a washing machine according to an embodiment, which is subsequent to FIG. 14.

DETAILED DESCRIPTION

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present specification and the configurations shown in the drawings are only examples of preferred embodiments of the present disclosure, and various modifications may be made at the time of filing of the present disclosure to replace the embodiments and drawings of the present specification.

Identical symbols or numbers in the drawings of the present disclosure denote components or elements configured to perform substantially identical functions.

The terms used herein are for the purpose of describing the embodiments and are not intended to restrict and/or to limit the present disclosure. For example, the singular expressions herein may include plural expressions, unless the context clearly dictates otherwise. In addition, the terms "comprises" and "has" are intended to display that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to differentiate one component from another. For example, without departing from the scope of the present disclosure, the first component may be referred to as a second component, and similarly, the second component may in addition be referred to as a first component. The term "and/or" includes combinations of one or all of a plurality of associated listed items.

The terms, such as "-part", "-device", "-block", "-member", "-module", and the like may refer to a unit for processing at least one function or act. For example, the terms may refer to at least process processed by at least one hardware, such as field-programmable gate array (FPGA)/application specific integrated circuit (ASIC), software stored in memories, or processors.

Reference numerals used for method steps are just used for convenience of explanation, but not to limit an order of the steps. Thus, unless the context clearly dictates otherwise, the written order may be practiced otherwise.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

Hereinafter, an embodiment of a washing machine and a method of controlling the same will be described in detail with reference to the accompanying drawings.

Figure 1:
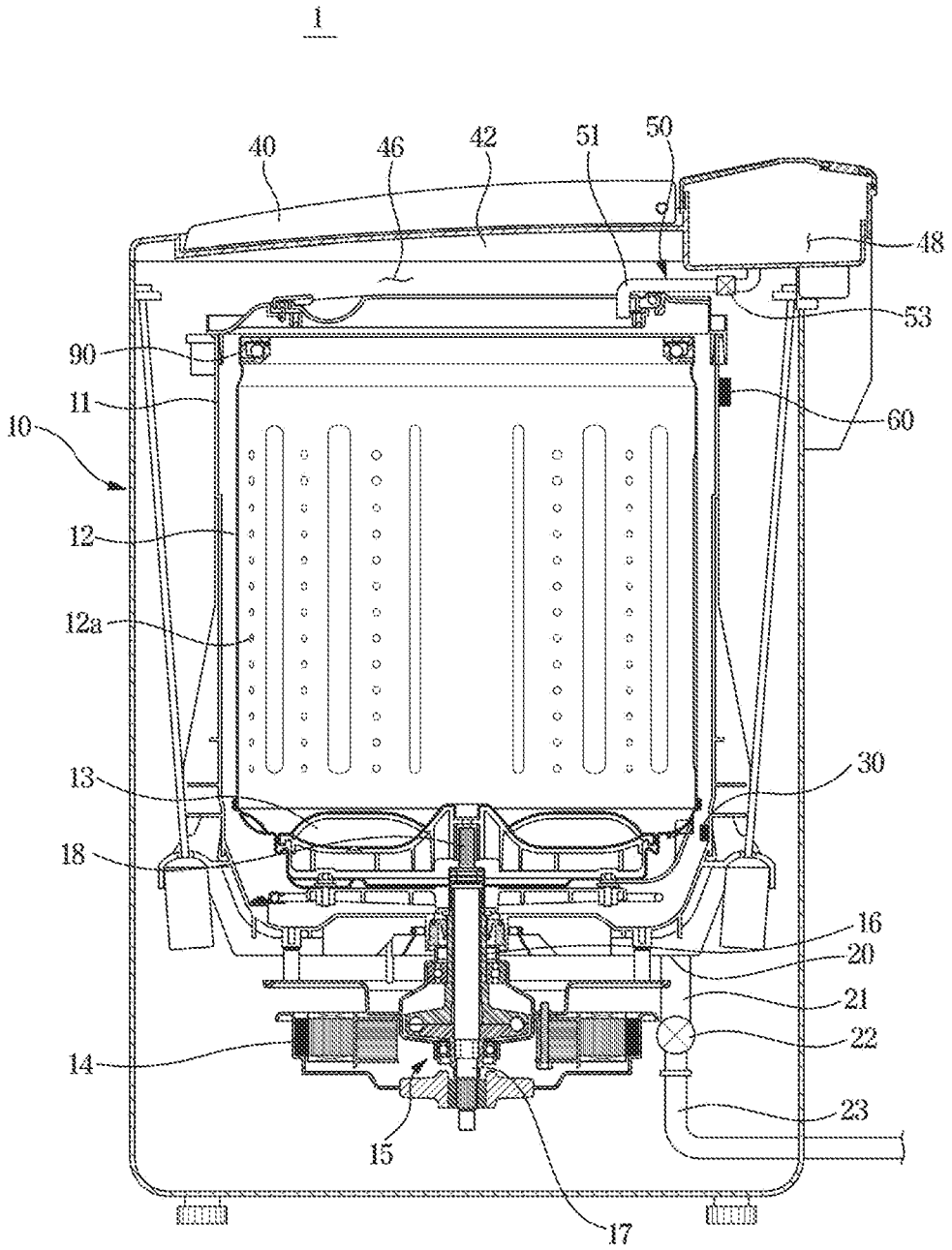
FIG. 1 is a cross-sectional view illustrating a configuration of a washing machine having a ball balancer according to an embodiment.

FIG. 1 is a cross-sectional view illustrating a configuration of a washing machine having a ball balancer according to an embodiment.

In FIG. 1, a washing machine 1 according to an embodiment of the disclosure includes a main body 10 forming the external appearance, a tub 11 installed inside the main body 10 to accommodate water (washing water or rinsing water) therein, a rotating tub 12 rotatably installed inside the tub 11 to accommodate laundry, a pulsator 13 rotatably installed inside the tub 12 to rotate leftward or rightward (forward rotation or backward rotation) to generate a water current, as a full automatic washing machine having a vertical axis.

The rotating tub 12 is provided in a cylindrical shape having an upper side that is open, and having a lateral side with a plurality of dehydrating holes 12*a*.

A washing motor 14 and a power switching device 15 are installed at a lower outer side of the tub 11. The washing motor 14 generates a driving force to rotate the rotating tub 12 and the pulsator 13. The power switching device 15 simultaneously or selectively transmits the driving force generated from the washing motor 14 to the rotating tub 12 and the pulsator 13.

A hollow dehydrating shaft 16 is coupled to the rotating tub 12, and a washing shaft 17 installed in a hollow portion of the dehydrating shaft 16 is coupled to the pulsator 13 through a washing shaft coupling part 18.

The washing motor 14 is a direct drive (DD) motor having a variable velocity function. The washing motor 14 may selectively transmit a driving force to the rotating tub 12 or the pulsator 13 according to ascending and descending of the power switching device 15.

In addition, the washing motor 14 may employ a universal motor including a field coil and an armature or a brushless direct (BLDC) motor including a stator and a rotor, and any one of motors applicable to the washing machine 1 may be allowed as the washing motor. In addition, the washing motor 14 may be provided as a belt type.

The tub 11 is provided on the bottom thereof with a drain hole 20 to discharge water from the tub 11 to the outside of the tub 11, where a first drain tube 21 is connected to the drain hole 20. A drain motor 22 for controlling drainage is installed on the first drain tube 21, and a second drain tube 23 for discharging water to the outside is connected to an outlet of the drain motor 22.

Although, in an embodiment, the drain motor 22 draining water is installed, the disclosure is not limited thereto, but a drain pump or drain valve may be installed.

In addition, at a lower inside of the tub 11, a water level sensor 30 for detecting a frequency varying according to a water level is installed to detect the amount (the water level) of water in the tub 11.

A door 40 and a top cover 42 are installed at an upper side of the main body 10. Opening or closing the door 40 can allow laundry to be inserted into or withdrawn from the rotating tub 12. The door 40 can be mounted onto the top cover 42.

The top cover 42 is provided with a laundry port 46 to allow laundry to be inserted into or withdrawn from the rotating tub 12, and the laundry port 46 may be opened and closed by the door 40.

In addition, a detergent box 48 and a water supply device 50 are installed at a rear upper side of the main body 10. The detergent box 48 can supply detergent and fabric softener and the water supply device 50 can supply water (washing water or rinsing water).

The water supply device 50 includes a water supply tube 51 connecting an external water supply tube and the detergent box 48 to supply water (washing water or rinsing water) into the tub 11, and a water supply valve 53 installed at an intermediate portion of the water supply tube 51 to control the supply of hot or cold water. With such a configuration, water supplied into the tub 11 is allowed to be supplied into the tub 11 via the detergent box 48 so that the detergent may be supplied to the tub 11 together with the water.

A vibration sensor 60 is installed at the upper outer side of the tub 11. The vibration sensor 60 measures vibrations of the tub 11 generated when the rotating tub 12 rotates eccentrically due to unbalanced laundry during a dehydrating cycle. The vibration sensor 60 may be provided using a micro electric mechanical system (MEMS) sensor for measuring the displacement of the tub 11 moving according to the vibrations of the tub 11, a three-axes direction acceleration sensor for measuring vibrations in three axes (an X-axis direction, a Y-axis direction, and a Z-axis) of the tub 11, and a gyro sensor that is an angular velocity sensor. In this case, a displacement signal measured by the vibration sensor 60 is generally used to estimate the balance state of laundry in the rotating tub 12 during acceleration from low velocity to high velocity to determine whether a high-velocity dehydrating operation is performed, to reduce the vibration of the tub 11 during the dehydrating cycle.

Meanwhile, in the embodiment of the disclosure, the vibration sensor 60 is illustrated as being installed at the upper outer side the tub 11, but the disclosure is not limited thereto, and the same object and effect as the disclosure may be achieved even when the vibration sensor 60 may be installed at the upper side of the main body 10 on which a control panel is installed, or may be installed at any place where vibrations of the tub 11 generated during the dehydrating cycle may be detected.

During a washing cycle or a rinsing cycle, the washing motor 14 rotates the rotating tub 12 in the forward direction and in the reverse directions at a low velocity so that the laundry accommodated in the rotating tub 12 rotates leftward and rightward along the inner wall of the rotating tub 12 while contaminants are removed from the laundry.

During a dehydrating cycle, the washing motor 14 rotates the rotating tub 12 in one direction at a high velocity, so that water is separated from the laundry by a centrifugal force acting on the laundry.

Upon unbalance in which laundry is not evenly distributed inside the rotating tub 12 and concentrated on a specific part during the rotation of the rotating tub 12 in the dehydrating operation, a one-sided force is applied to a rotating shaft, that is, the dehydrating shaft 16, so that strong vibration and noise are generated.

Therefore, the washing machine 1 according to an embodiment of the disclosure is provided with a ball balancer 90 at the upper side of the rotating tub 12 such that the rotating tub 12 may be stably rotated during the dehydrating cycle. Descriptions thereof will be made with reference to FIGS. 2 and 3.

Figure 2:
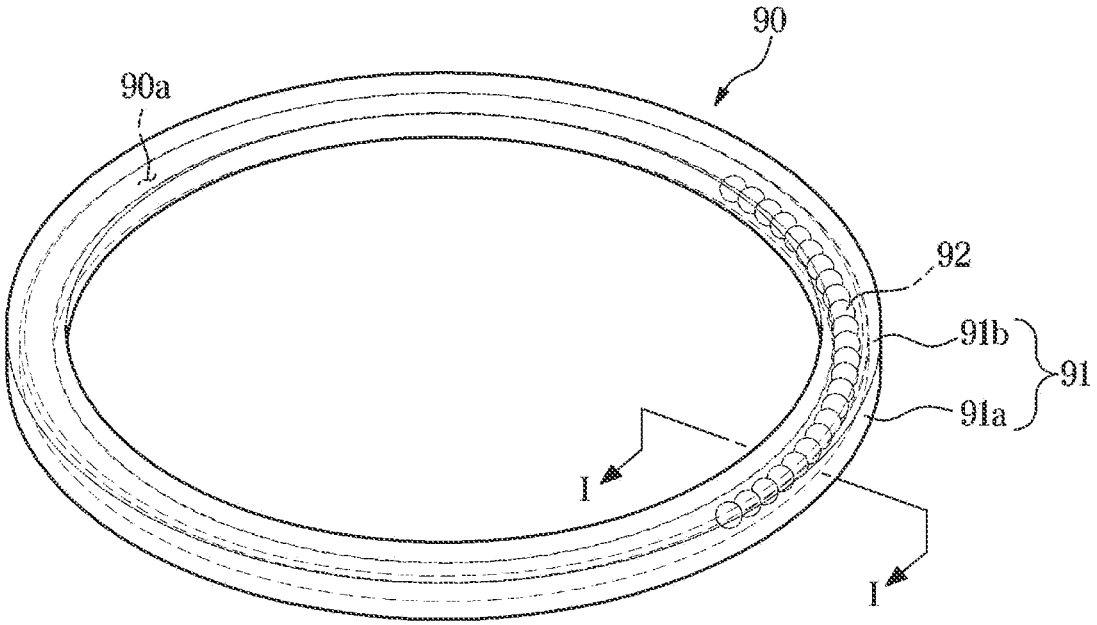
FIG. 2 is a perspective view illustrating a ball balancer applied to a washing machine according to an embodiment.
Figure 3:
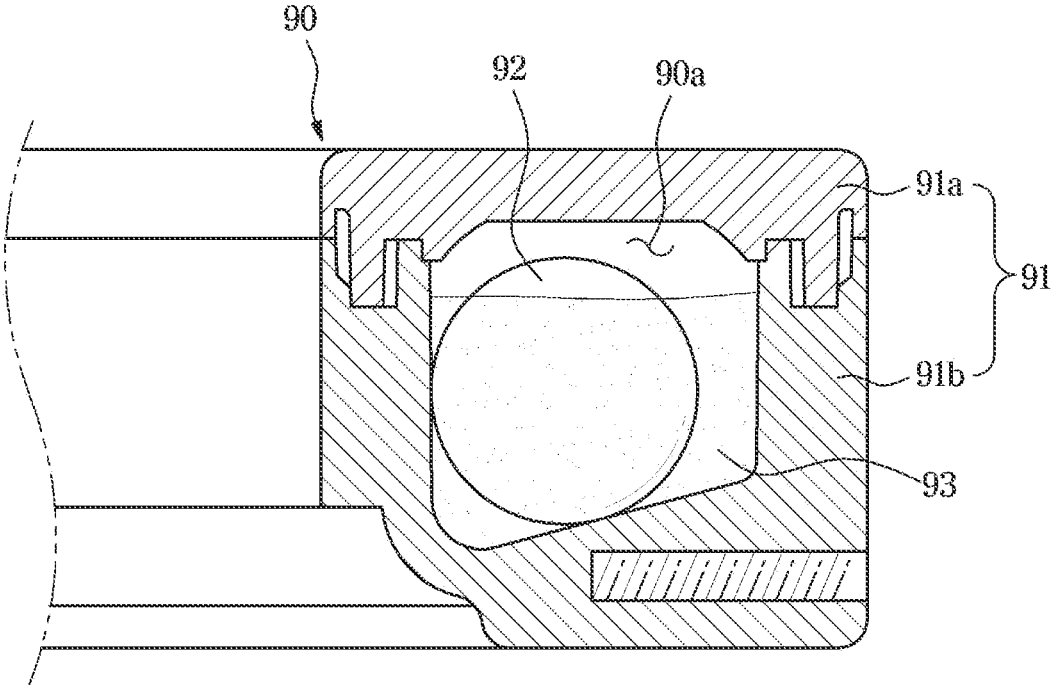
FIG. 3 is a cross-sectional view taken along line I-I in FIG. 2.

FIG. 2 is a perspective view illustrating a ball balancer applied to a washing machine according to an embodiment, and FIG. 3 is a cross-sectional view taken along line I-I in FIG. 2;

Referring to FIGS. 2 and 3, the ball balancer 90 is formed in a circular ring shape and includes a balancer housing 91 provided inside thereof with a track 90*a* in a circular ring shape, a plurality of balls 92 movably installed inside the balancer housing 91, a viscous oil 93 formed to have a certain viscosity and filled to a certain level inside the track 90*a*. Accordingly, the plurality of balls 92 may move in the circumferential direction of the rotating tub 12 along the track 90*a*.

In the embodiment of the disclosure, the balancer housing 91 includes a first balancer housing 91*a* and a second balancer housing 91*b* each formed in a circular ring shape and vertically coupled to each other to form the circular ring track 90*a* therebetween. The first balancer housing 91*a* is formed to have a U-shaped cross-section and forms an upper surface, an inner circumferential surface, and an outer circumferential surface of the track 90*a*, and the second balancer housing 91*b* covers the open upper side of the first balancer housing 91*a* to form the upper surface of the track 90*a*.

The track 90*a*, as described above, is formed in a circular ring shape and has a width and a height larger than a diameter of the balls 92, and guides the balls 92 to move in the circumferential direction according to the rotation of the rotating tub 12. The track 90*a* is formed to have a sufficient width in comparison to the diameter of the balls 92. This is to allow the balls 92 to also move in the radial direction by the centrifugal force acting on the balls 92 during rotation of the rotating tub 12.

Moreover, in the embodiment of the disclosure, the track 90*a* has a lower surface that slopes upward in a radial outer direction, and the outer circumferential surface of the track 90*a* has a diameter larger than that of the balls 92. This is to allow the balls 92 to move in the radial outer direction along the lower surface of the track 90*a*, that is, a sloping surface, only when the centrifugal force acting on the balls 92 exceeds a certain level.

The balls 92 are formed of spherical metal and are disposed to be movable in the circumferential direction of the rotating tub 12 along the track 90*a* to offset the unbalanced load generated in the rotating tub 12 due to unbalance of laundry when the rotating tub 12 rotates. When the rotating tub 12 rotates, the balls 92 move along the track 90*a* and perform a balancing function on the rotating tub 12.

The viscous oil 93 is filled in the track 90*a* to have an oil surface lower than the diameter of the balls 92. In the embodiment of the disclosure, the amount of the viscous oil 93 filled in the track 90*a* is set such that the balls 92 may be completely submerged in the viscous oil 93 in a state in which the viscous oil 93 and the balls 92 have been moved in the radial direction by the centrifugal force.

The track 90*a* is provided with a width that is relatively larger than a depth thereof. In the embodiment, since the lower surface of the race 90*a* is inclined, the width of the track 90*a* is relatively larger than the average depth of the race 90*a*. When the width and the depth of the track 90*a* are formed as described above, the width of the viscous oil 93 moved in the radial direction by the centrifugal force is larger than the height of the viscous oil 93 for when the viscous oil 93 is filled in the lower portion of the track 90*a* by its own weight. In addition, upper sides of the balls 92 supported on the lower surface of the track 90*a* by its own weight protrude over the upper side of the oil surface of the viscous oil 93, while the balls moved in the radial direction by the centrifugal force are completely submerged in the viscous oil 93.

In a case in which the track 90*a* and the viscous oil 93 are configured as described above, when the rotating tub 12 rotates at a low velocity and the centrifugal force acting on the balls 92 is weak, the balls 92 remain at the radial inner side of the track 90*a* within the track 90*a*. In this state, the upper sides of the balls 92 are exposed to the outside of the viscous oil 93, and a viscosity force applied to the balls 92 is relatively weak and thus the balls 92 may move in the circumferential direction.

Meanwhile, the ball balancer 90 may be installed on at least one of the upper side or the lower side of the rotating tub 12, and the following description will be made in relation that the ball balancer 90 is installed on the upper side of the rotating tub 12 as an example.

Figure 4:
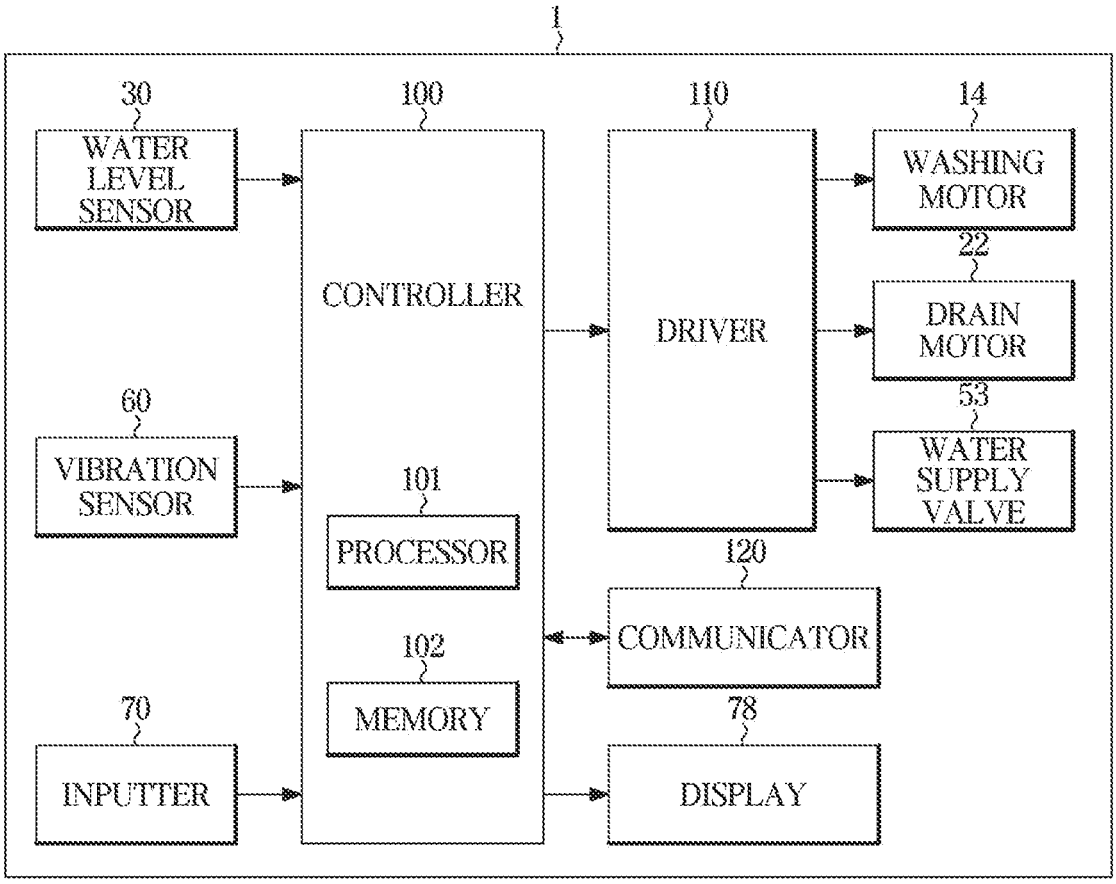
FIG. 4 is a control block diagram illustrating a washing machine according to an embodiment.

FIG. 4 is a control block diagram illustrating a washing machine 1 according to an embodiment.

Referring to FIG. 4, the washing machine 1 according to an embodiment of the disclosure includes an inputter 70, a display 78, a driver 110, a communicator 120, and a controller 100 including a processor 101 and a memory 102.

The controller 100 may include the memory 102 that stores a program for executing operations described below and various types of data, and the processor 101 that processes data by executing the program stored in the memory 102.

The memory 102 may store a vibration limit value at a time of leveling (a value basically input when the set is shipped) set in the washing machine 1, a vibration limit value reset through an installing mode after an initial installation (or installation after movement) of the washing machine 1, and a rotation velocity in a unique resonance band of the washing machine 1.

In addition, the memory 102 may store control data for controlling of operations of the washing machine 1, reference data used in controlling operations of the washing machine 1, operation data generated during the performance of a predetermined operation of the washing machine 1, setting information, such as setting data input by the inputter 70 for the washing machine 1 to perform a predetermined operation, times when the washing machine 1 has performed a specific operation, use information including model information of the washing machine, and malfunction information including the cause or location of a malfunction.

The memory 102 may include at least one of a volatile memory 102, such as a Static Random Access Memory (S-RAM), D-RAM, etc., or a non-volatile memory 102, such as a flash memory 102, a read only memory (ROM), an erasable programmable read only memory (EPROM), electrically erasable programmable read only memory (EEPROM), and the like.

The non-volatile memory 102 may operate as an auxiliary storage device of the volatile memory 102, and may keep stored data even when power of the washing machine 1 is cut off. For example, the non-volatile memory 102 may store a control program and control data for controlling of operations of the washing machine 1.

Unlike the non-volatile memory 102, the volatile memory 102 may lose stored data when power of the washing machine 1 is cut off. The volatile memory 102 may load the control programs and control data from the non-volatile memory 102 and temporarily store the loaded control programs and control data, or temporarily store set values or control commands input through the inputter 70, or temporarily store control signals output from the processor 101 and the like.

The processor 101 may process data or output a control signal according to a program stored in the memory 102.

The processor 101 and the memory 102 may be provided in a single component or in multiple components depending on the capacities thereof. In addition, the processor 101 and the memory 102 may be physically separated from each other or may be provided as a single chip.

The inputter 70, which inputs commands to perform a washing cycle, a rinsing cycle, and a dehydrating cycle of the washing machine 1 by a manipulation of a user, may include keys, buttons, switches, a touch pad, and the like, and may include all types of devices generating preset input data by a manipulation, such as press-in, contact, pressure, and rotation.

In addition, the inputter 70 includes a plurality of buttons (power-on, reservation, washing, rinsing, dehydrating, water level selection, etc.) to input user commands related to operations of the washing machine 1. The plurality of buttons include a course selecting button to select a washing course (washing courses including a standard course, a wool course, a boiling course, etc.) according to the type of laundry loaded into the washing machine 1.

The controller 100 is a microcomputer to control overall operations of the washing machine 1, such as washing, rinsing, and dehydrating, according to operating information input from the inputter 70, and may set the amount of washing water (a target water level for washing), the amount of rinsing water (a target water level for rinsing), a target RPM, a motor operating rate (an ON time and an OFF time of the washing motor 14), a time for washing, and a time for rinsing according to the weight (load) of the laundry in the selected washing course.

In addition, the controller 100 may be configured to, based on a washing cycle or a rinsing cycle being ended, drive the drain motor 22; based on a level of the water in the tub 11 reaching a first water level threshold, drive the washing motor 14 such that the rotating tub 12 is rotated at a predetermined velocity for a first period of time; and based on the first period of time elapsing, stop the washing motor 14 and the drain motor 22.

Here, the first water level threshold may vary depending on the mass of a vibrating system and specifications (stiffness and damping) of a damper used in the washing machine. Specifically, a required amount of residual water may vary according to the mass of the vibrating system and the damper specifications (stiffness and damping), and accordingly, the first water level threshold may be derived through an experiment based on the specifications of the washing machine.

For example, the washing machine according to an embodiment may determine, as the first water level threshold, a level of about 12 L at a time when the rotating tub starts to move at 0 rpm.

Thereafter, the washing machine may, based on the washing motor 14 being stopped, drive the drain motor 22 for a second period of time.

In this case, since the washing motor 14 may require a longer time to stop in comparison with the drain motor 22 due to inertia, the drain motor 22 may stand by in a stopped state while the washing motor 14 is being stopped.

Thereafter, the controller 100 may, upon the second period of time elapsing, stop the drain motor 22 and based on the washing motor 14 and the water drain motor 22 being stopped, drive the washing motor 14 and the water drain motor 22 according to a dehydrating profile.

Specifically, the controller 100 may, based on the water level in the tub 11 in a process of entering the dehydrating cycle reaching the first water level threshold, drive the washing motor 14 to rotate the rotating tub 12 at a predetermined velocity for the first period of time.

In this case, since the controller 100 drives the washing motor 14 while in operation of the drain motor 22, vibrations generated from drainage of water may perform a ball release cycle in which balls inside the ball balancer are released. Specifically, the controller 100 may, upon the balls being located at the same side as the eccentricity when entering a dehydrating cycle, allow the balls to be located at a side opposite to the unbalance position to pass through an initial low-RPM region (e.g., lower than or equal to 100 RPM) in the early stage of dehydrating and perform normal dehydrating.

The controller may, in order to pass through the low-RPM region in the early stage of dehydrating, primarily use the weight of residual water, and maintain an RPM higher than or equal to a resonance RPM (e.g., 80 RPM) for a certain period of time such that the balls are located to a side opposite to the unbalance position.

In this case, in order to move the balls in a direction opposite to the unbalance position, vibrations of the tub need to become stronger but the residual water retained in the tub may prevent the balls from moving. Accordingly, the controller 100 may perform drain for the first period of time without stopping the drain motor to reduce the weight of the tub and increase the amount of vibration, so that the balls may be effectively moved in a direction opposite to the unbalance position.

Thereafter, the controller 100 may determine a velocity higher than a rotation velocity in a predetermined resonance band of the rotating tub 12 as a predetermined velocity for ball balancing for the first period of time.

The controller 100 may determine the first period of time based on the position of unbalance of the rotating tub 12, and may determine, as the first period of time, a time required to compensate for unbalance by a vector sum of the mass and the position of balls inside the ball balancer as the balls are located at a phase opposite to the unbalance position.

That is, the controller 100 may rotate the rotating tub 12 at an RPM higher than the resonance point for the first period of time to move the balls in the direction opposite to the unbalance position. Accordingly, in a subsequent dehydrating cycle, the balls are located in a direction opposite to the unbalance position, thereby compensating for the imbalanced mass and minimizing vibration and noise.

Thereafter, the controller 100 may determine the second period of time based on the water level measured by the water level sensor 30 after the washing motor 14 is stopped. Specifically, the controller 100 may drive the drain motor 22 after the washing motor 14 is stopped, and based on the water level in the tub 11 not reaching the second water level threshold, increase the second period of time.

That is, the controller 100 may, based on the water level in the tub 11 not reaching the second water level threshold even with the second period of time that is determined based on the water level in the tub after the ball balancing is performed, identify that foams are not sufficiently discharged and thus increase the second period of time.

However, the determining of the second period of time by the controller may represent a case in which a component for drainage is defective and thus proper drainage is not achieved.

Therefore, in a normal state in which water is smoothly drained, residual water may not be present in the tub when the washing motor is stopped. Accordingly, the water level at second water level threshold may not be detected, or the second period of time may be adjusted by sensing the water level at predetermined time intervals during operation of the drain motor.

The driver 110 may drive the washing motor 14 and the drain motor 22 related to the operation of the washing machine 1 and turn the water supply valve 53 on or off according to a driving control signal from the controller 100.

The display 78 may display the operating state of the washing machine 1 and the manipulation state of the user according to a display control signal of the controller 100.

Hereinafter, operations and effects of a washing machine having a ball balancer according to an embodiment and a method of controlling the washing machine will be described.

Figure 5:
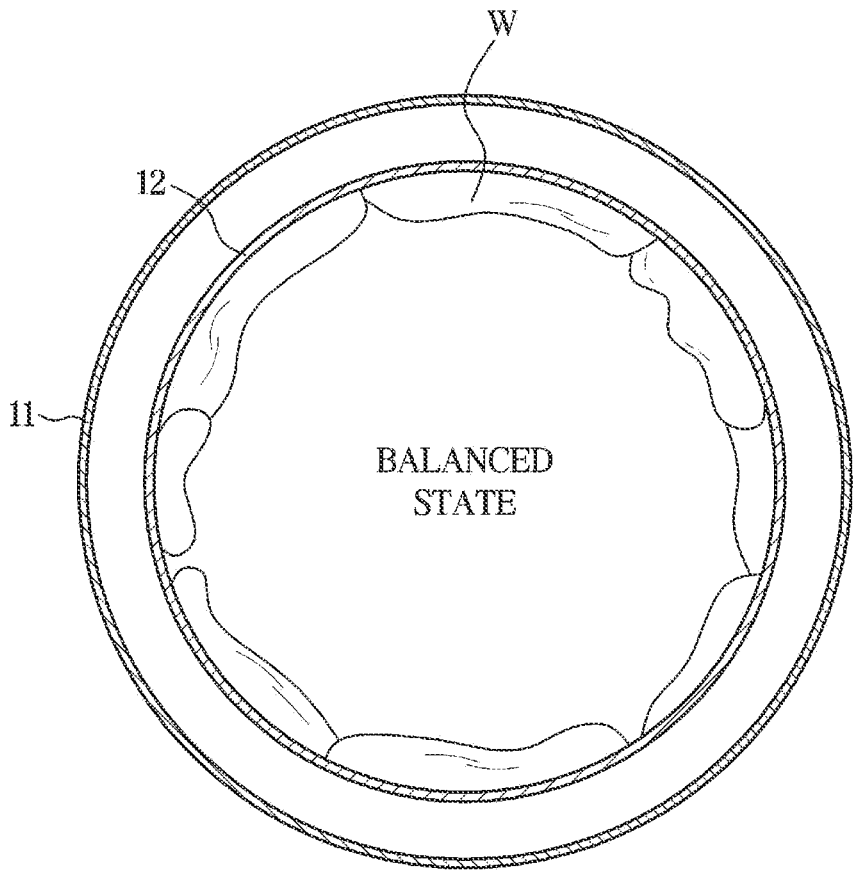
FIG. 5 is a diagram illustrating a balanced state of laundry inside a rotating tub in a general washing machine.
Figure 6:
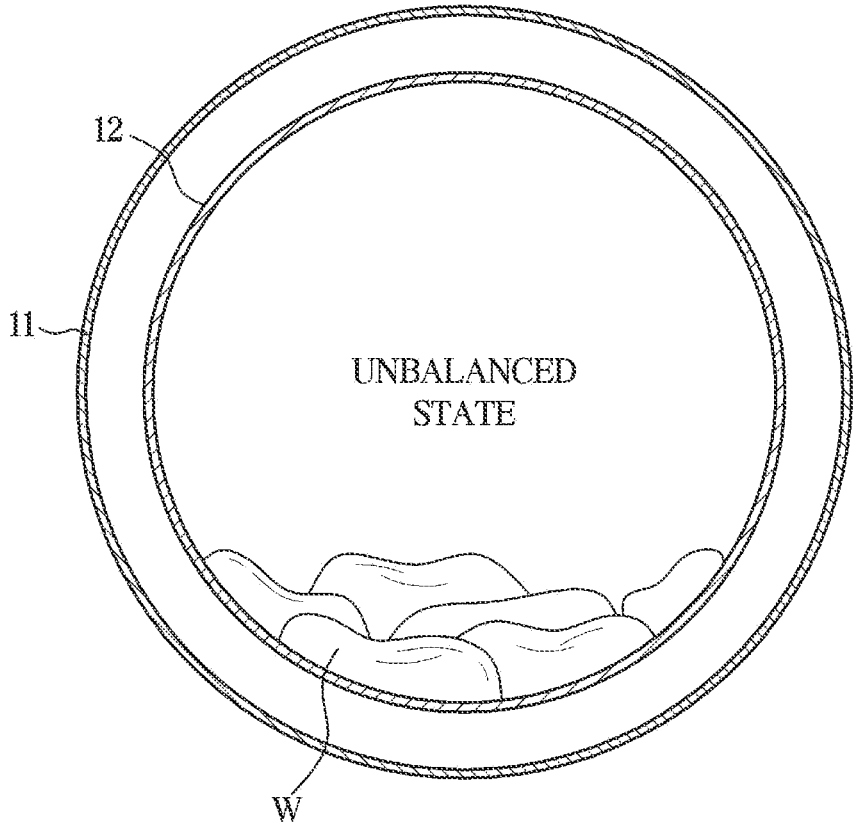
FIG. 6 is a diagram illustrating an unbalanced state of laundry inside a rotating tub in a general washing machine.

FIG. 5 is a diagram illustrating a balanced state of laundry inside a rotating tub in a general washing machine, and FIG. 6 is a diagram illustrating an unbalanced state of laundry inside a rotating tub in a general washing machine.

In general, the washing machine 1 is a device that performs washing on laundry using movement of laundry W and a water current generated by rotating of the rotating tub 12 as the washing motor 14 is driven. In a dehydrating cycle, the rotating tub 12 rotates at a high velocity of 700 rpm to 1000 rpm, and vibrations and noise are generated. The vibrations and noise during the dehydrating cycle greatly vary depending on distribution of laundry immediately before the dehydrating cycle.

Referring to FIG. 5, in a balance state in which the laundry W is evenly distributed on the inner wall of the tub 12, vibrations or noise may not occur in the tub 11 even when the rotating tub 12 is rotated at a high velocity for dehydrating cycle.

However, as illustrated in FIG. 6, in an unbalanced state in which the laundry W is not evenly distributed in the rotating tub 12, when the rotating tub 12 is rotated at a high velocity for dehydrating cycle, an unbalance load generated by the unbalance of the laundry W may cause a one-sided force to be applied to the rotating shaft of the rotating tub 12, and thus the rotating tub 12 are allowed to eccentrically move and great vibrations occur in the tub 11 and thus noise is generated.

Accordingly, in an embodiment of the disclosed disclosure, the rotating tub 12 is provided on the upper side thereof with a ball balancer 90 offsetting the unbalanced load generated by the unbalance of the laundry W (see FIG. 1) to stabilize the rotation of the rotating tub 12.

In the ball balancer 90, when an unbalance load is generated by unbalance of the laundry W during rotation of the rotating tub 12, the balls 92 inside the balancer housing 91 move in the circumferential direction of the rotating tub 12 to a position symmetrical to a place at which the unbalance load is generated. In this case, the balls 92 are opposed to the unbalanced load, and thus suppress vibrations of the tub 11 generated by the unbalanced load.

In the dehydrating cycle, since the laundry W remains wet inside the rotating tub 12, an unbalance phenomenon is highly likely to occur. Therefore, in order to suppress the vibrations of the tub 11 in an early stage entering the dehydrating, the ball balancer 90 needs to balance the rotating tub 12 within a short time when the dehydrating cycle starts.

When the dehydrating rotation of the rotating tub 12 starts as the washing motor 14 is driven, the rotation velocity of the rotating tub 12 begins to increase.

In the early stage entering the dehydrating process, since the viscous oil 93 filled inside the ball balancer 90 may not push the balls 92 upward so that the balls 92 inside the ball balancer 90 may move while colliding with the inner wall of the balancer housing 91 or colliding with each other, so there is a difference in rotation velocities between the balls 92 and the rotating tub 12.

Due to the difference in rotation velocities between the rotating tub 12 and the balls 92, a resonance point occurs in which the tub 11 vibrates excessively.

When the laundry W is unbalanced, vibrations of the tub 11 become worse before the balls 92 reach a balance position (a position at which balls are positioned opposite to the laundry "W"). Accordingly, the balls 92 meant to suppress vibrations in the early stage entering the dehydrating process otherwise cause excessive vibrations of the tub 11 together with the washing machine W. Details thereof will be described with reference to FIGS. 7 to 10.

Figure 7:
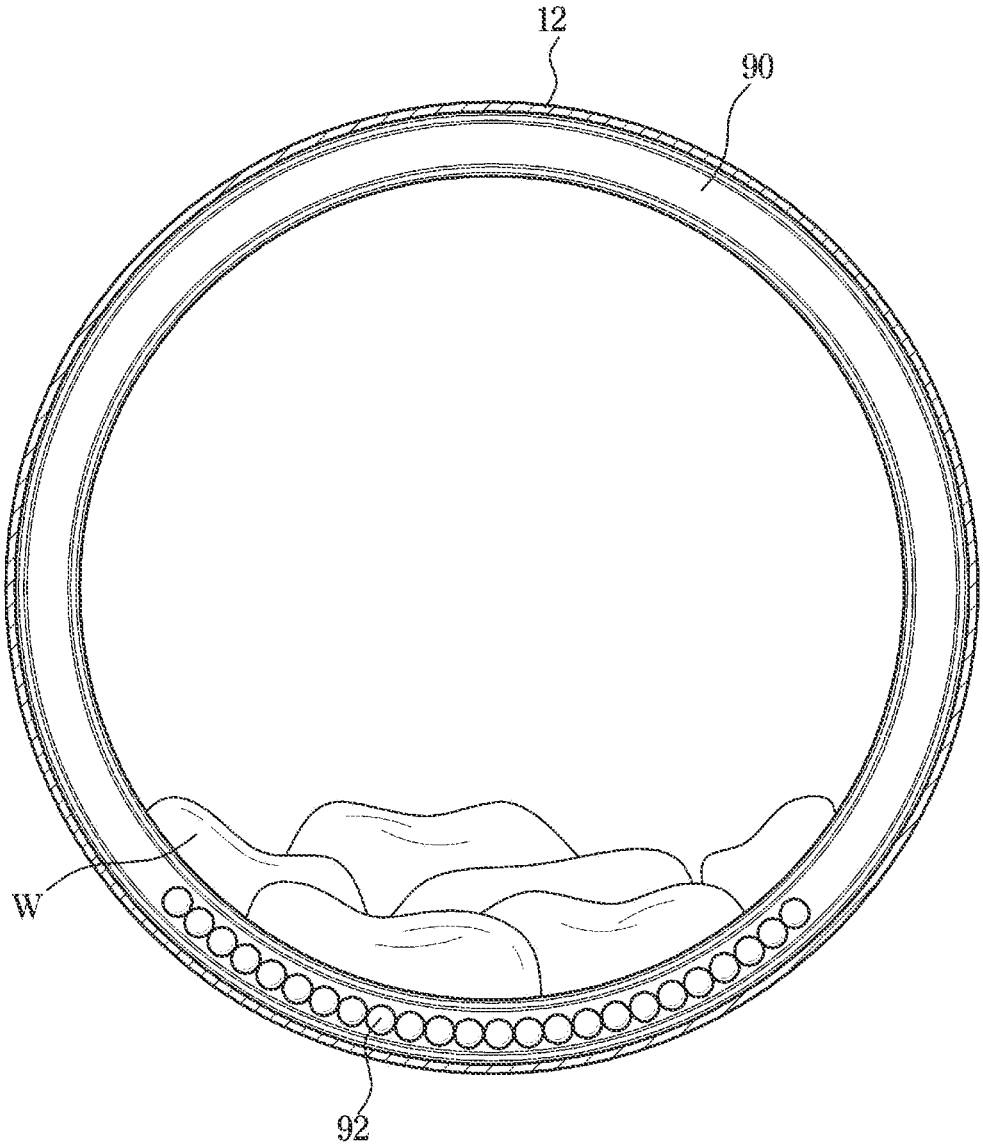
FIG. 7 is a diagram illustrating a case in which balls and laundry are at the same phase in a washing machine having a ball balancer according to an embodiment.
Figure 8:
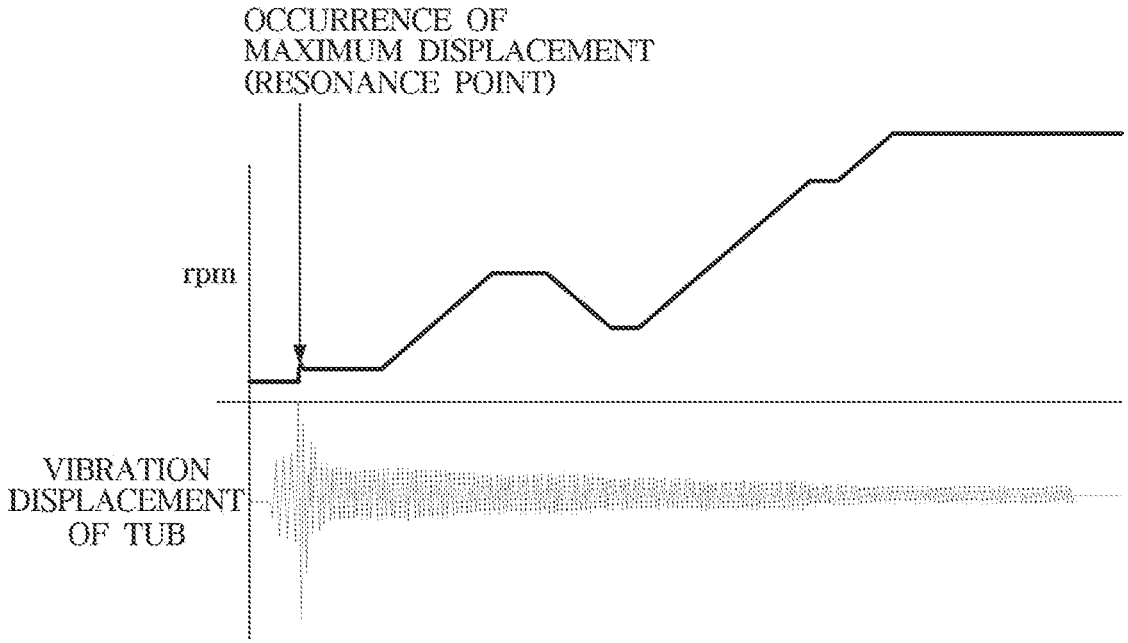
FIG. 8 is a diagram illustrating a rotation velocity of a washing motor and a vibration displacement of a tub in a case of FIG. 7.
Figure 9:
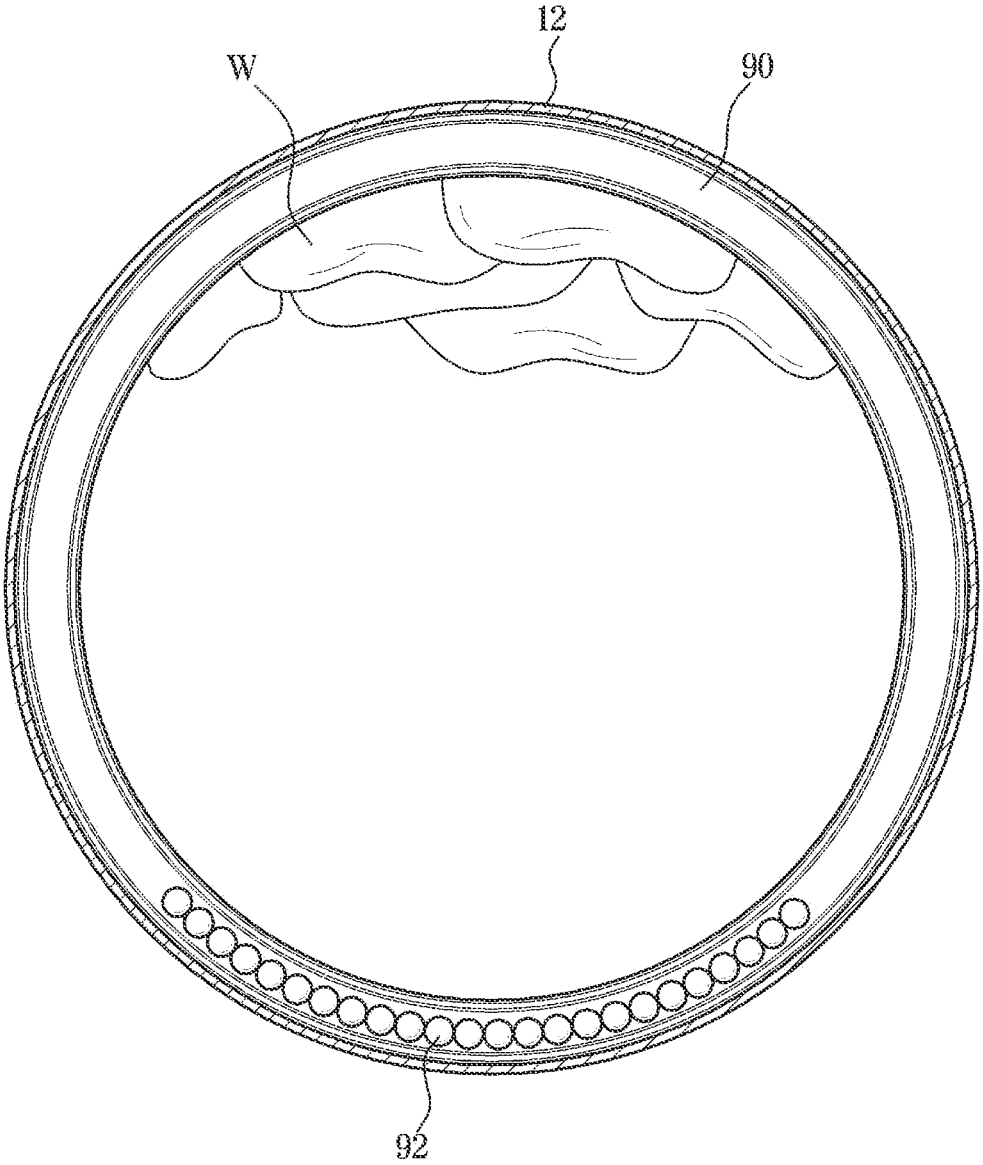
FIG. 9 is a diagram illustrating a case in which balls and laundry are at the opposite phases in a washing machine having a ball balancer according to an embodiment.
Figure 10:
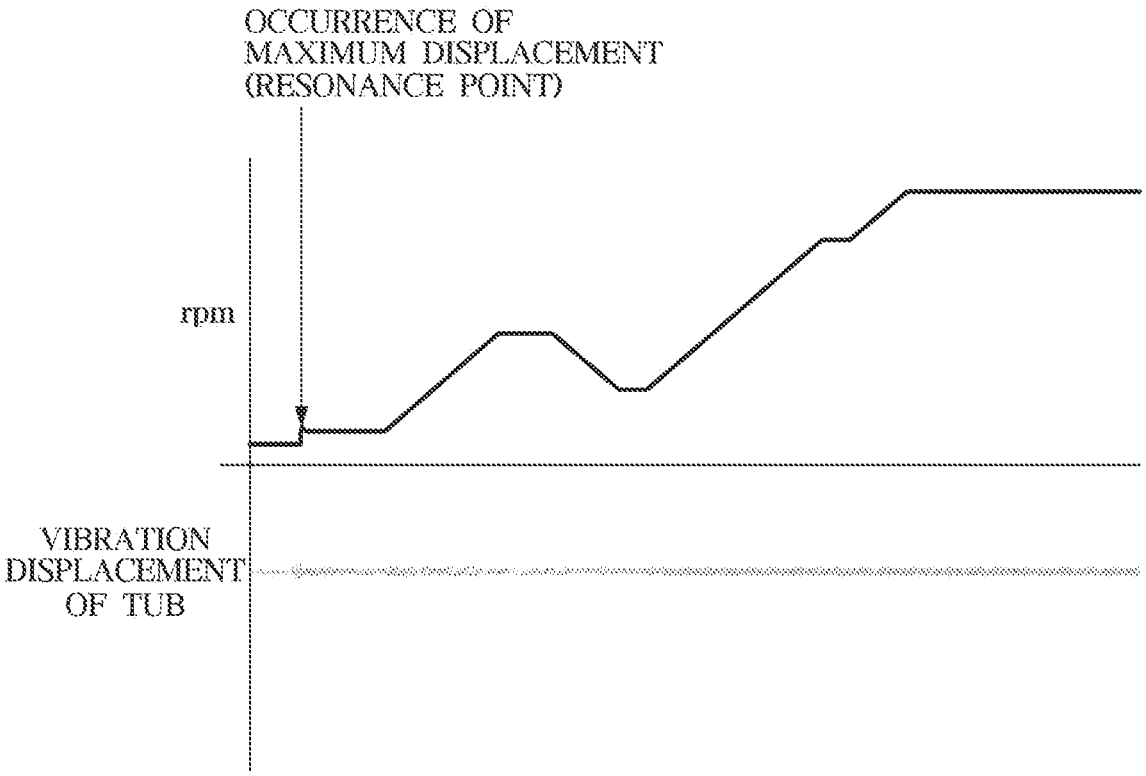
FIG. 10 is a diagram illustrating a rotation velocity of a washing motor and a vibration displacement of a tub in a case of FIG. 9.

FIG. 7 is a diagram illustrating a case in which balls and laundry are at the same phase in a washing machine having a ball balancer according to an embodiment, FIG. 8 is a diagram illustrating a rotation velocity of a washing motor and a vibration displacement of a tub in a case of FIG. 7, FIG. 9 is a diagram illustrating a case in which balls and laundry are at the opposite phases in a washing machine having a ball balancer according to an embodiment, and FIG. 10 is a diagram illustrating a rotation velocity of a washing motor and a vibration displacement of a tub in a case of FIG. 9.

As illustrated in FIG. 7, when the balls 92 inside the ball balancer 90 are positioned at the same phase (the same position) as that of the unbalanced load generated by unbalance of the laundry W, the vibration displacement of the tub 11 may be maximally generated while passing the resonance point in the early stage entering the dehydrating process, as illustrated in FIG. 8.

When a gap distance between the tub 11 and the frame of the washing machine 1 is not sufficient, the tub 11 may strike the frame of the washing machine 1 and apply a shock to the main body 10, resulting in failure of dehydration in which the dehydrating cycle may not be performed.

On the other hand, as illustrated in FIG. 9, when the balls 92 inside the ball balancer 90 are positioned at a phase (the opposite phase) opposite to that of the unbalanced load generated by the unbalance of the laundry W, the vibration displacement of the tub 11 may not be greatly generated even when passing the resonance point in the early stage of entering the dehydrating process because the unbalance load is not great, as illustrated in FIG. 10.

Accordingly, in a dehydrating cycle in which unbalance is highly likely to occur, a dehydrating cycle capable of releasing the balls 92 inside the ball balancer 90 before passing through the resonance point and reducing the vibrations of the tub 11 is required.

To this end, the washing machine according to an embodiment may locate the balls to a position opposite to the unbalance even when the rotating tub 12 is rotated at a high velocity in an unbalanced state (see FIG. 6) in which the laundry W is not evenly distributed in the rotating tub 12.

In addition, the washing machine according to an embodiment may determine an additional drainage time afterward, to prevent foam confinement from occurring. Details thereof will be described with reference to FIGS. 11 and 12.

(a) of FIG. 11, (b) of FIG. 11, and (c) of FIG. 11 are graphs showing a ball balancing and an additional drainage in a washing machine 1 according to an embodiment.

In (a) of FIG. 11 to (c) of FIG. 11, a graph showing a method of controlling vibrations in a dehydrating cycle in a washing machine 1 according to an embodiment is illustrated, the controller 100 may curb ball concentration when entering a dehydrating cycle, and through an additional drainage time subsequent to the ball balancing, prevent foam confinement from occurring.

The controller 100 may, when entering the dehydrating cycle, drive the drain motor 22 to drain the water to a certain water level. In this process, since the controller 100 is driving the washing motor 14, the RPM of the rotating tub 12 may be maintained at 80 RPM.

In this case, the controller 100 maintains the washing motor 14 at 80 RPM based on experimental data, to locate the balls of the ball balancer at a phase opposite to the unbalance position while generating less foam.

The controller 100 needs to set the rotation RPM for ball balancing to a level appropriately higher than the resonance RPM in order to suppress excessive generation of foams in consideration that the amount of foam generation is proportional to the rotational RPM of the rotating tub 12.

Accordingly, the controller 100 may set the ball balancing RPM to 80 RPM such that the balls of the ball balancer are located at the phase opposite to the unbalance position while generating less foam.

(a) of FIG. 11 represents a state in which the washing or rinsing cycle is completed. Since a ball balancing process is performed when entering a dehydrating, the controller 100 does not need to identify the exact positions of the balls.

However, in (a) of FIG. 11, assumed is a case in which the balls are located at the same position as the phase of unbalance when the washing or rinsing cycle is completed, and thus vibration and noise during dehydrating are the largest.

Referring to (b) of FIG. 11, the controller 100 may, when entering dehydrating, increase the RPM of the rotating tub 12 to 80 RPM for ball balancing.

As for a full automatic washing machine 1 with an 25-inch, the primary resonance (pendulum) occurs at about 54 rpm to 60 rpm, and in order to locate the balls at the phase opposite to the imbalanced mass, the RPM of the rotating tub 12 needs to be higher than the resonance RPM.

Accordingly, the controller 100 may, in order to smoothly perform ball balancing while lowering the possibility of foam confinement, increase the RPM of the rotating tub 12 to 80 RPM and maintain the RPM as shown in (b) of FIG. 11.

Thereafter, referring to (c) of FIG. 11, since the controller 100 has maintained the RPM of the rotating tub 12 at 80 RPM (beyond the resonance point) for a certain period of time, the balls inside the ball balancer may be located at the phase opposite to the unbalance position.

However, in a process of performing the ball balancing, residual water present in the tub 11 may cause foam to be generated by detergent during rotation of the rotating tub 12. In this case, depending on the amount of detergent used by the user and the components of the detergent, excessive foaming, that is, foam confinement, may occur.

Accordingly, as the rotating tub 12 rotates at a high velocity, the amount of foam generated further increases, and the viscous friction of the foam generated between the tub 11 and the rotating tub 12 may cause an overload to be detected in the motor and thus normal dehydrating may not be achieved.

However, in order to resolve such an issue in the washing machine 1 according to an embodiment, the controller 100 may set an additional drainage time (e.g., 80 seconds) after the ball balancing cycle is performed.

In this case, the foam confinement may be prevented from occurring by allocating an additional drainage time in a state in which the motor is completely stopped after the ball balancing, in addition to properly setting the balancing RPM using the characteristics that the amount of foam generation, which is the cause of foam confinement, is proportional to the RPM of the rotating tub 12.

(a) of FIG. 12, (b) of FIG. 12, and (c) of FIG. 12 are graphs showing the amount of residual water, a vibration of a tub 11, and a rotation velocity of a washing motor 14 over time in a washing machine according to an embodiment;

Similar to (a) of FIG. 11 to (c) of FIG. 11, (a) of FIG. 12 represents a state in which the washing or rinsing cycle is completed, and illustrates a case in which the balls are located at the same position as the phase of unbalance when the washing or rinsing cycle is completed, and thus vibration and noise during dehydrating are the largest.

When entering a state of FIG. (b) of FIG. 12 from a state of (a) of FIG. 12, the drain motor 22 is operating after the first water level threshold is reached, and thus the amount of residual water may continuously decrease.

In addition, since the controller 100 allows the washing motor 14 to operate while the drain motor 22 operates, irregular vibrations may occur in the tub 11 due to a change in the amount of residual water in a process of residual water being drained, and thus a ball release cycle in which the balls inside the balancer are released may be performed.

Then, the controller 100 may increase the RPM of the rotating tub 12 up to 80 rpm for ball balancing. In this case, since the balls inside the ball balancer have been released to be movable, and the RPM is maintained at 80 RPM that exceeds the resonance point (54 RPM to 60 RPM based on the 25-inch full automatic washing machine 1), the ball balancing cycle may be performed.

Accordingly, as shown in FIG. (c) of FIG. 12, there is no residual water in the tub 11, and the controller 100 may control the washing machine 1 for the balls inside the ball balancer to be located at the phase opposite to the unbalance position.

The controller 100 may, while the balls inside the ball balancer are located at the phase opposite to the unbalance position, stop the washing motor 14 and the drain motor 22 and then drive only the drain motor 22 to perform an additional drainage for a time of about 140 seconds to 220 seconds.

In this case, since balls of the ball balancer inside the washing machine 1 have been already located at the phase opposite to the unbalance by the ball balancing cycle, the controller 100 may, after the additional drainage, proceed with a dehydrating cycle according to a dehydrating profile input by the inputter 70.

The washing machine 1 according to the conventional art is implemented to, when entering a dehydrating, drain water after reaching an RPM, which is sufficiently higher than the resonance point, while residual water is present in the rotating tub 12, and thus detergent inside the rotating tub 12 may excessively generate foam.

On the other hand, unlike the conventional art, the washing machine 1 according to an embodiment is implemented to drain water in a process of reaching the resonance point, and has an additional drainage time even after reaching the resonance point, so that generation of form inside the rotating tub 12 may be minimized.

FIG. 13 is a cross-sectional view illustrating a configuration of a washing machine having a ball balancer according to another embodiment.

In FIG. 13, a washing machine 1 according to another embodiment of the disclosure may include a ball balancer 90 provided on a lower side of a rotating tub 12.

In a case in which the ball balancer 90 is provided on the lower side of the rotating tub 12, the resonance point at which excessive vibrations of the tub 11 occur becomes higher (to a level higher than or equal to 80 rpm) in comparison with a case in which the ball balancer 90 is provided on the upper side of the rotating tub 12, the rotation velocity of the washing motor 14 may be set to a velocity higher than a predetermined velocity.

In addition, when the ball balancer 90 is installed on the lower side of the rotating tub 12, the balancing of the rotating tub 12 may be achieved more rapidly than when the ball balancer 90 is installed on the upper side of the rotating tub 12. Therefore, the driving time of the washing motor 14 may be set to a time shorter than the first period of time and perform the ball release cycle of releasing the balls 92 inside the ball balancer 90.

Other algorithms than those described above are the same as the case in which the ball balancer is located on the upper side, so the same descriptions will be omitted below.

FIG. 14 is a flowchart showing a method of controlling a washing machine according to an embodiment.

Referring to FIG. 14, the controller 100 of the washing machine 1 according to an embodiment may identify whether a washing or rinsing cycle is completed according to a washing or rinsing cycle profile input by a user (1400).

Thereafter, the controller 100 may, upon identifying that the washing or rinsing cycle is completed and the operation enters a dehydrating cycle (YES in operation 1400), drive the drain motor 22 (1410).

The controller 100 may drive the drain motor 22 to drain the water in the tub 11, and identify whether the water level in the tub 11 reaches the first water level threshold, which is a preset value, by the water level sensor 30 provided in the washing machine 1 (1420).

The controller 100 may, upon identifying that the water level in the tub 11 has not reached the first water level threshold as water is drained to the outside of the washing machine 1 by the driving of the drain motor 22 (NO in operation 1420), continue draining water and stand by.

The controller 100 may, upon identifying that the water level in the tub 11 has reached the first water level threshold as water is drained to the outside of the washing machine 1 by the driving of the drain motor 22 (YES in operation 1420), drive the washing motor 14 at a predetermined velocity (1430).

In this case, the reason for the controller 100 driving the washing motor 14 at a predetermined velocity is to perform a ball releasing cycle and a ball balancing cycle, and the predetermined velocity may be a velocity (e.g., 80 RPM) at which foam confinement is unlikely to occur and the ball balancing is smoothly performed.

Thereafter, the controller 100 may drive the washing motor 14 at the predetermined velocity for a first period of time, and the controller 100 may identify whether the first period of time has elapsed (1440).

The controller 100 may, upon identifying that the first period of time has elapsed (YES in operation 1440), stop the washing motor 14 and the drain motor 22 (1450).

This may be to perform an additional drainage time as shown in FIG. 15 for the controller 100 to prevent foam confinement, in which case the ball balancing cycle may be already completed, and the balls inside the ball balancer may be located at a phase opposite to the unbalance position.

FIG. 15 is a flow chart showing a method of controlling a washing machine 1 according to an embodiment, which is subsequent to FIG. 14.

Referring to FIG. 15, the controller 100 may identify whether the washing motor 14 and the drain motor 22 are in a stopped state, and the washing motor 14 is in a stopped state (1500).

That is, since foam is no longer generated and discharged to the outside only by performing an additional drainage in a state in which the washing motor 14 is stopped, the controller 100 may identify whether the washing motor 14 is in a stopped state.

Thereafter, the controller 100 may, upon identifying that the washing motor 14 is in a stopped state (YES in operation 1500), drive the drain motor 22 (1510).

The controller 100 may set an additional drainage time for which foam is discharged to the outside of the washing machine 1 by driving the drain motor 22, and may identify whether a second period of time, which is the additional drainage time, has elapsed (1520).

The controller 100 may, upon identifying that the second period of time has elapsed (YES in operation 1520), identify that the foam, which is the cause foam confinement, has been sufficiently discharged to the outside, and drive the washing motor 14 according to a dehydrating profile input by the user (1530).

Thereafter, the controller 100 may identify whether the dehydrating cycle is completed (1540), and upon identifying that the dehydrating cycle is completed (YES in operation 1540), stop the washing motor 14 and the drain motor 22 (1550) to terminate the washing.

As described above, with the method of controlling the washing machine 1 according to an embodiment, vibration and noise may be minimized even in an unbalance situation in which the center of mass of laundry does not coincide with the center of the rotating shaft, and also foam confinement may be prevented by the additional draining time, thereby preventing failure of the washing machine 1 while improving durability.

Meanwhile, the embodiment of the disclosure has been described in relation to a full automatic washing machine with a vertical shaft as an example, but the disclosure is not limited thereto and the same object and effect may be achieved in a drum type washing machine with a horizontal shaft.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a tub provided to accommodate water therein;

a rotating tub rotatably installed inside the tub;

a ball balancer provided in the rotating tub;

a washing motor configured to rotate the rotating tub;

a drain motor configured to drain water from the tub; and a controller configured to:

based on completing a washing cycle or a rinsing cycle, drive the drain motor;

while the drain motor is being driven, based on a water level in the tub reaching a first water level threshold, drive the washing motor for a first period of time; and based on the first period of time elapsing, stop the washing motor and the drain motor, wherein the controller is configured to, based on bringing the washing motor to a stopped state, drive the drain motor for a second period of time, and wherein the controller is configured to determine the first period of time based on an unbalance position of the rotating tub.

2. The washing machine of claim 1, wherein the controller is configured to:

based on the second period of time elapsing, stop the drain motor; and based on bringing the washing motor and the drain motor to stopped states, drive the washing motor and the drain motor according to a dehydrating profile.

3. The washing machine of claim 1, wherein the controller is configured to drive the washing motor for the first period of time at a velocity higher than a rotation velocity in a predetermined resonance band of the rotating tub.

4. The washing machine of claim 1, wherein the controller is configured to determine, as the first period of time, a time required to compensate for unbalance by a vector sum of a mass and a position of balls inside the ball balancer as the balls are located at a phase opposite to the unbalance position.

5. The washing machine of claim 1, further comprising a water level sensor, wherein the controller is configured to control the water level sensor to measure the water level in the tub after the washing motor is stopped.

6. The washing machine of claim 5, wherein the controller is configured to determine the second period of time based on the water level measured by the water level sensor after the washing motor is stopped.

7. The washing machine of claim 6, wherein the controller is configured to:

drive the drain motor after the washing motor is stopped, and based on the water level in the tub not reaching a second water level threshold within the second period of time, increase the second period of time.

8. The washing machine of claim 1, wherein the controller is configured to, based on the water level in the tub reaching the first water level threshold in a process of entering a dehydrating cycle, while the drain motor is being driven, drive the washing motor for the first period of time.

* * * * *